United States Patent [19]

Aughuet

[11] 3,994,107

[45] Nov. 30, 1976

[54] CURTAIN WALL STRUCTURE

[75] Inventor: Armand Alphonse Aughuet, Tubize, Belgium

[73] Assignee: Applications de la Chimie, de l'Electricite et des Metaux, en abregen "SADACEM", Brussels, Belgium

[22] Filed: Oct. 6, 1975

[21] Appl. No.: 620,036

[30] Foreign Application Priority Data

Feb. 17, 1975 Belgium ..... 153436

[52] U.S. Cl. ..... 52/235; 52/468; 52/582

[51] Int. Cl.[2] ..... E04H 1/00

[58] Field of Search ..... 52/235, 487, 509, 468, 52/573, 403, 396, 582

[56] References Cited

UNITED STATES PATENTS

| | | | |
|---|---|---|---|
| 3,110,131 | 11/1963 | Jeffress | 52/235 X |
| 3,316,681 | 5/1967 | Eber | 52/235 |
| 3,465,996 | 9/1969 | Wedel | 52/235 X |
| 3,742,669 | 7/1973 | Mansfeld | 52/396 |
| 3,888,599 | 6/1975 | Reifsnyder | 52/396 X |

*Primary Examiner*—Price C. Faw, Jr.
*Assistant Examiner*—Carl D. Friedman
*Attorney, Agent, or Firm*—Scully, Scott, Murphy & Presser

[57] ABSTRACT

There is described a curtain wall structure in which each glazed element is supported in one point by a compensation bar which is part of the glazed element, which bears on or hangs from a swivel joint projecting from the building skeleton, said element being further retained by members for taking over the forces due to the wind.

7 Claims, 6 Drawing Figures

CURTAIN WALL STRUCTURE

This invention pertains to a new type of curtain wall which differs from the structure presently known by a possibility for the glazed elements comprising same to adapt without distortion and consequently without danger of breakage of the glazing, to the distortions which are imparted to a building with such a structure.

The use of large-size glazing has indeed been developed since a few years. Presently a single glazing covering the height of one story and the width of one module is no more an exception. It is thus necessary to make use of glazings with a size up to 11 feet by 6 feet, that is an unit area larger than 64.5 square feet. When a building built on a heterogeneous piece of ground has a long frontage, provision is made for a slow evolution of the foundation subsidence and of the beam flowing. This phenomenon causes level changes in the range of inches and in some cases makes it necessary to perform regularly height adjustments which enable to bring the frontage elements back in horizontal alignment.

To the slow and irreversible sets appearing in the time interval between two adjustments are added reversible distortions due to the action of the wind, to the changes in temperature and to the living loads.

The invention has for object to obviate these drawbacks and relates more particularly to a curtain wall structure which comprises glazed elements mounted inside metal frames.

For this purpose each glazed element is supported in one point by a compensation bar which is part of the glazed element, which bears on or hangs from a swivel joint projecting from the building skeleton, said element being further retained by members for taking over the forces due to the wind.

In an advantageous embodiment of the invention, the metal frame for each glazed element is joined to the metal frame of an overlying or underlying element by means of connecting pins the male and female elements of which are arranged alternately on the upper and lower ends or vice versa, of said metal frames.

A feature of the invention lies in the metal frames of adjacent glazed elements both in the horizontal and vertical directions, being joined together by a flexible-material shaped sealing element.

An important feature of the invention lies in said sealing element having at the level of the intersection of the vertical and horizontal symmetry planes between the vertical and horizontal rows of glazed elements, the shape of a cross.

Other details and features of the invention will stand out from the description given below by way of non limitative example and with reference to the accompanying drawings in which.

The glazed element according to the invention is essentially comprised of a metal frame 1 bearing a glazing 2 which is mounted according to usual techniques which are not part of the present invention.

Figure 1:
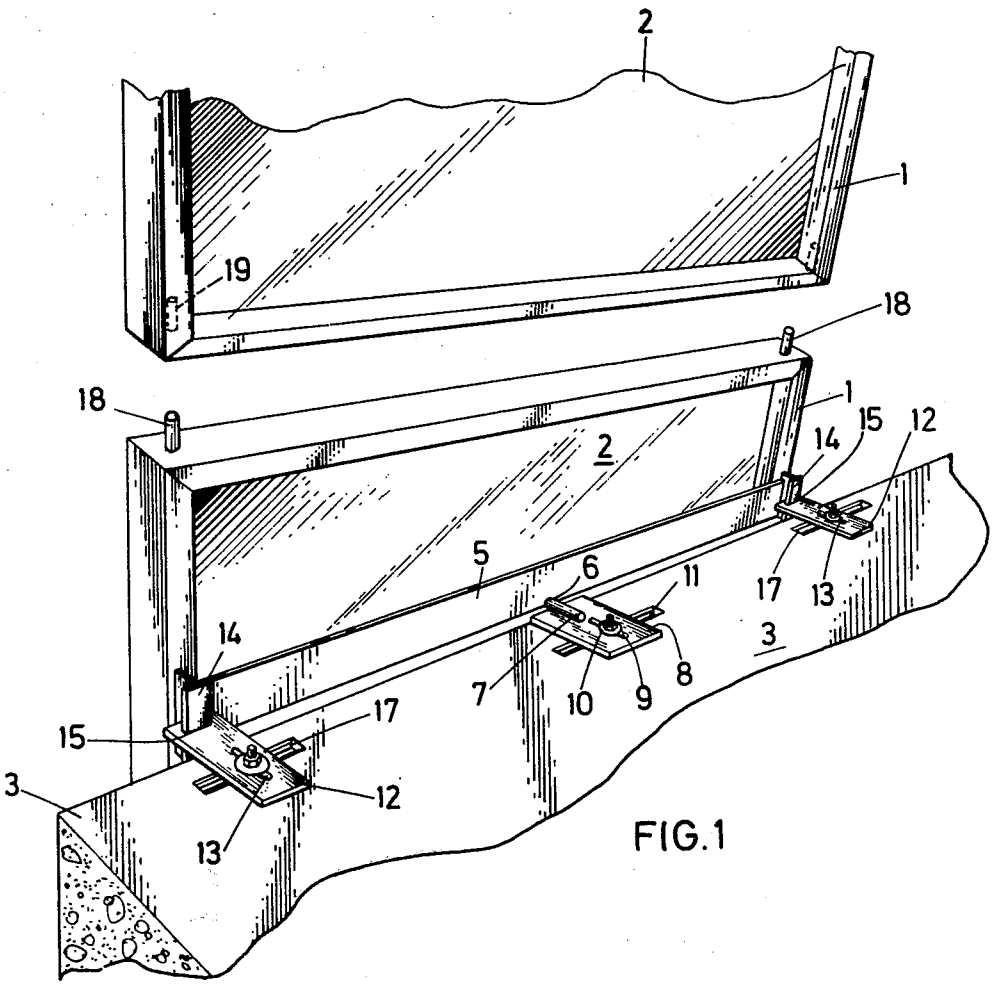
FIG. 1 is a perspective view of the essential elements for the suspension in a point of the metal frame of a glazed element according to the invention.

The element shown is to be used for forming a curtain wall in a building part of the skeleton of which is shown diagrammatically in 3 in FIG. 1.

Figure 3:
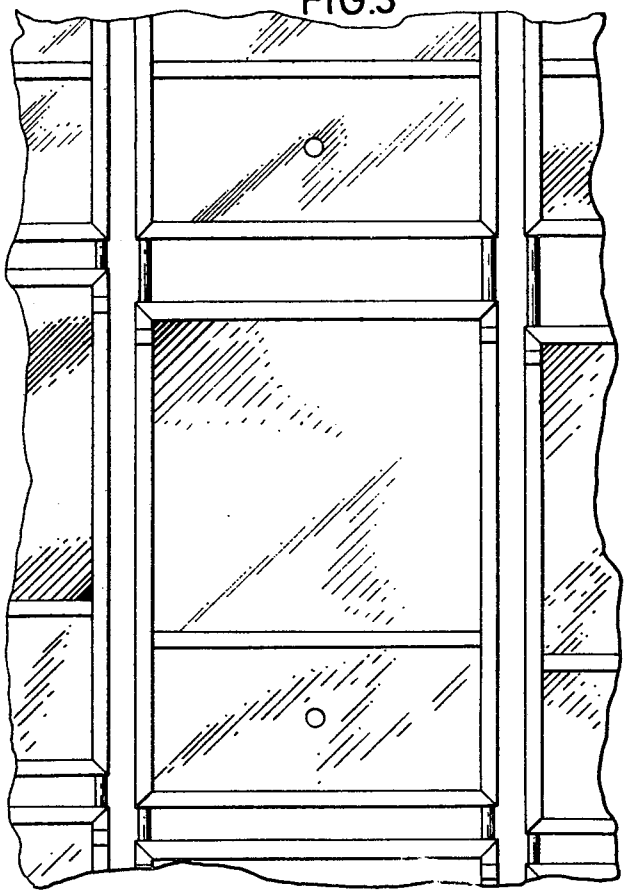
FIGS. 2 and 3 show diagrammatically the holding of a glazed element in a curtain wall, respectively inside an undistorted skeleton and inside a skeleton the distortions of which have been shown oversize.
Figure 2:
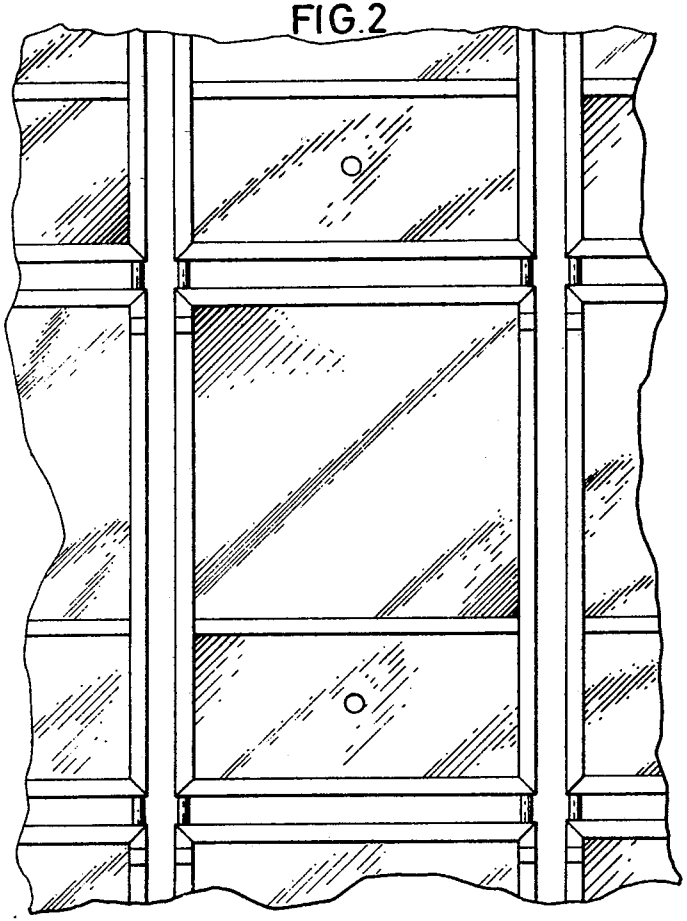

In the embodiment shown in FIG. 1, the compensation bar 5 which connects the uprights of metal frame 1 is mounted in the top portion of said frame but it could also be mounted in the bottom portion as shown in FIGS. 2 and 3.

A notch 6 is provided midway in the compensation bar. Inside said notch fits a horizontal swivel joint 7 which is joined to the building skeleton 3 through a mounting which is adjustable both along a direction in parallel relationship with the general frontage plane and along a direction at right angle thereto. Said mounting which is but a detail of the invention can be comprised of a plate 8 with a slot 9 and an adjusting knob 10 which can be moved both along the axis of slot 9 and along the axis of a slot 11 provided in the mass of skeleton 3.

Members for taking over the forces due to the wind, which each comprise a plate 12 with a slot 13 and sections 14 cooperating with a front notch 15 in the same section, are provided at both side ends of each metal frame. The adjustment of plates 12 is also made by means of a bolt 16 which is movable along the axis of slots 13 and 17. Said slot 17 is provided in the building skeleton.

Each glazed element is adjusted through the frame thereof relative to the frame of an overlying element, by means of male and female connecting pins 18 and 19.

Figure 5:
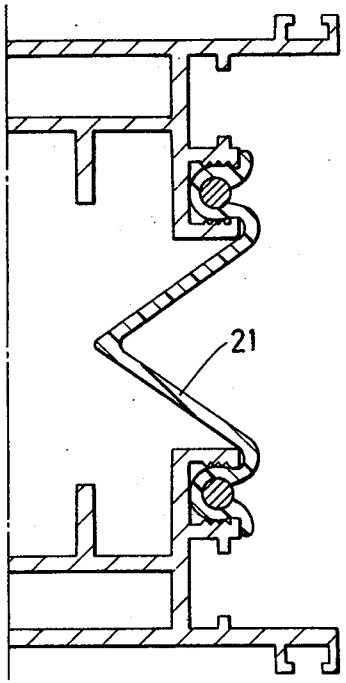
FIG. 5 is a section view through a first variation of the element as shown in FIG. 3.
Figure 4:
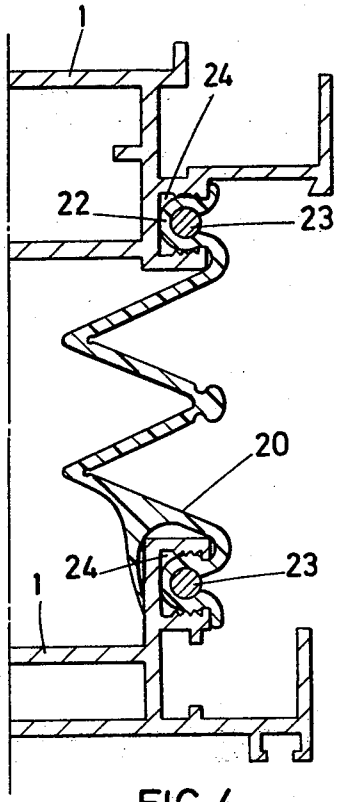
FIG. 4 is a section view through a shaped sealing element mounted between two adjacent metal frames.

As the distortions and sets of the building skeleton cause relatively substantial movements of the glazed elements, it is necessary to provide therebetween sealing elements which have a cross-section shape allowing easy distorting thereof under the glazed element stresses. FIGS. 4 and 5 show examples of cross-sections for flexible sealing elements 20 and 21 of W-or V-shape the bent ends 22 of which can easily be locked by means of strips 23 in open chambers 24 provided in those sectional parts comprising the metal frames 1. The material said sealing elements 20 and 21 are made of is preferably formed by synthetic rubbers, notably polychloroprene.

Figure 6:
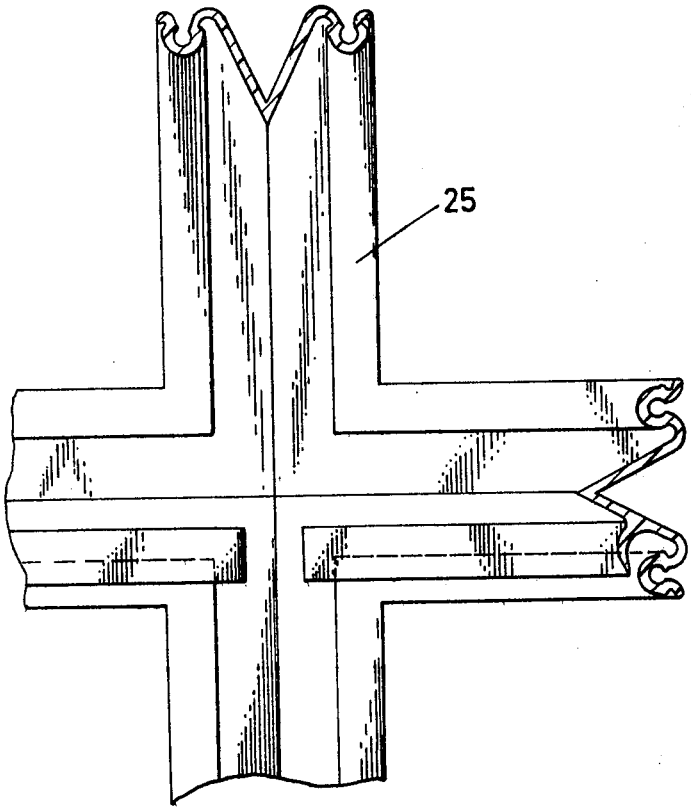
FIG. 6 is a front view of a cross-shaped element at the intersection of the symmetry planes between four adjacent glazed elements.

FIG. 6 show a cross-shaped sealing element 25 the cross-section of which can also be of V- or W-shape. Such a sealing element is arranged in the intersection of the vertical and horizontal symmetry planes between four adjacent elements. The integral element in the shape of a cross as shown in the figure is fastened by fusing or gluing to the adjacent straight sealing elements by means of the usual techniques of this art.

It is clear from the above that if all of the weight of a glazed element is brought to bear on the single swivel joint 7 in the vertical middle plane of said element, the distortions of the bearing stories will not induce any abnormal stress either in the element proper nor in the fastening element thereof.

Any distortion induced in the curtain wall structure according to the invention and any movement of a glazed element relative to the adjacent elements are taken over but by the flexible sealing elements the bellow or concertina-like cross-section of which allows to absorb the results of such distortions without same being transferred to other glazing elements.

It must be understood that the invention is in no way limited to the above embodiments and that many changes can be brought therein without departing from the scope of the invention as defined by the appended claims.

I claim:

1. Curtain wall structure having glazed elements comprised of a metal frame joined to the frontage of a building; a compensation bar supporting each said glazed element in one point on said frame; said compensation bar being part of the glazed element; a swivel joint projecting from the skeleton structure of the building, said compensation bar operatively bearing on or being suspended from said swivel joint; and operatively interengageable members on said elements and building for taking over forces generated due to wind loads acting on said curtain wall structure.

2. Curtain wall structure as claimed in claim 1, said operatively interengageable members for taking over the wind-generated forces each comprising plate members adjustably mounted on said building, said plate members each having a notch formed in the end thereof extending towards said metal frames; and metal sections being provided along the sides of said metal frames and being slidably receivable within the notches of said plate members.

3. Curtain wall structure as claimed in claim 1, comprising connecting pins joining said frame for each said glazed element to the respective metal frame of an overlying or underlying element, said connecting pins including cooperatively engageable male and female portions arranged alternately on the upper and lower ends of said metal frame.

4. Curtain wall structure as claimed in claim 1, comprising a shaped flexible material sealing element joining the metal frames of adjacent glazed elements in both horizontal and vertical directions.

5. Curtain wall structure as claimed in claim 4, said sealing element being in the shape of a cross at the level of the intersection of the vertical and horizontal rows of said glazed elements.

6. Curtain wall structure as claimed in claim 4, said sealing element being V-shaped in transverse cross-section.

7. Curtain wall structure as claimed in claim 4, said sealing element being W-shaped in transverse cross-section.

* * * * *